US006789631B1

(12) United States Patent
Realme, Sr., deceased et al.

(10) Patent No.: US 6,789,631 B1
(45) Date of Patent: Sep. 14, 2004

(54) ENGINE POWERED TORQUE WRENCH

(76) Inventors: Benito Realme, Sr., deceased, late of Pearsall, TX (US); Benito Realme, Jr., heir, 410 N. Vinton, Pearsall, TX (US) 78061

( * ) Notice: Subject to any disclaimer, the term of this patent is extended or adjusted under 35 U.S.C. 154(b) by 0 days.

(21) Appl. No.: 10/377,543

(22) Filed: Feb. 27, 2003

(51) Int. Cl.[7] ..... B27B 17/00

(52) U.S. Cl. ..... 173/162.2; 173/178; 173/216; 173/170

(58) Field of Search ..... 173/162.1, 162.2, 173/210, 211, 216, 217, 178, 213, 170; 30/381, 382, 383, 296, 392

(56) References Cited

U.S. PATENT DOCUMENTS

| | | | | | |
|---|---|---|---|---|---|
| 3,077,547 | A | * | 2/1963 | Metko | 173/217 |
| 3,990,523 | A | * | 11/1976 | Schramm et al. | 173/162.2 |
| 4,010,544 | A | * | 3/1977 | Siman | 30/381 |
| 4,856,195 | A | * | 8/1989 | Grossmann et al. | 30/369 |
| 5,345,684 | A | * | 9/1994 | Shoup et al. | 30/276 |
| 5,453,577 | A | * | 9/1995 | Everett et al. | 173/211 |
| 5,570,512 | A | * | 11/1996 | Hoppner | 30/383 |
| 5,855,067 | A | | 1/1999 | Taomo et al. | 30/122 |
| 6,019,179 | A | * | 2/2000 | Zurbes | 173/49 |
| 6,182,367 | B1 | | 2/2001 | Janczak | 30/392 |
| 6,438,852 | B2 | | 8/2002 | Taomo et al. | 30/383 |

* cited by examiner

*Primary Examiner*—Scott A. Smith
(74) *Attorney, Agent, or Firm*—Derek R. Van Gilder

(57) ABSTRACT

An engine-powered torque wrench (18) has a loop handle (19) that is orthogonal to a torque rod (22) of a torque handle. The engine-powered torque wrench has a heat engine (1) which rotates a toolhead (14) to which selected tools (25) or a striker gear (16) which can hold the selected tools is attachable. The loop handle is adapted to be hand-grasped by a first hand of a user for primary support of a system weight of the engine-powered torque wrench while selectively positioning a selected tool on a targeted item (23) which typically but not necessarily includes a fastener head (24). The torque handle is adapted to be hand-grasped by a second hand of the user for secondary support of the system weight while simultaneously using the second hand for assisting in positioning of the selected tool, leveraging against rotational moment of the tool heat engine and throttling heat engines which are not preset-throttled. The engine-powered torque wrench can be adapted for either right-handed or left-handed use and for either right-side access or left-side access to the targeted item.

23 Claims, 6 Drawing Sheets

FIG. 7
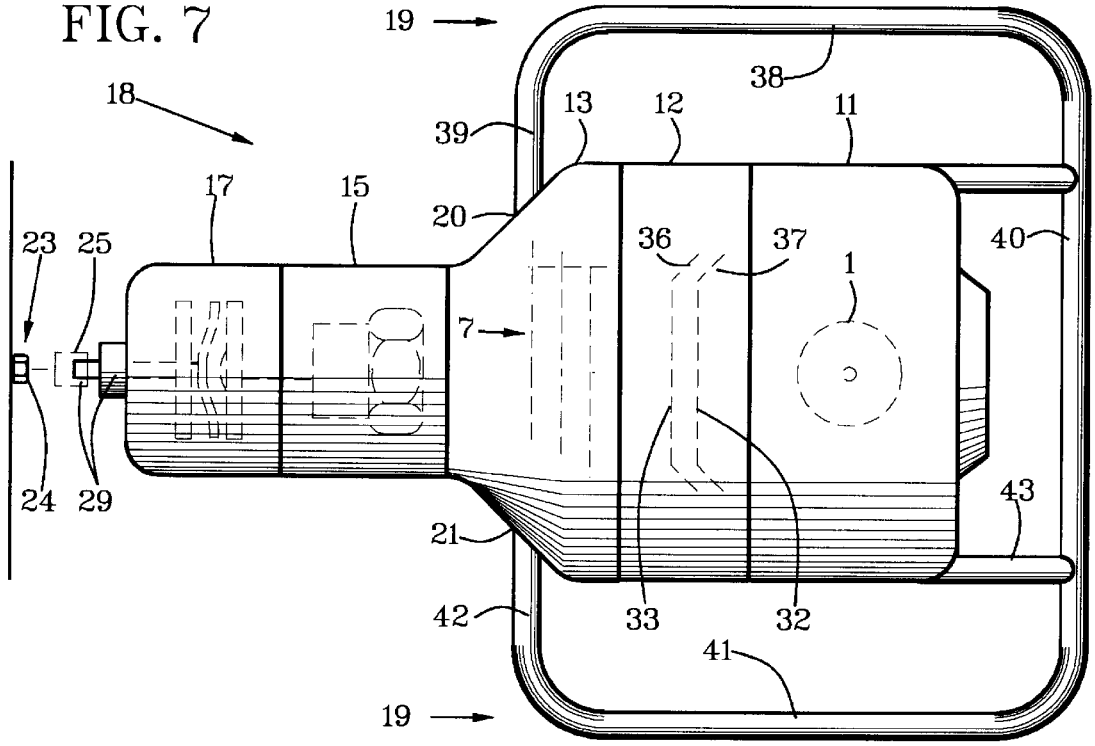
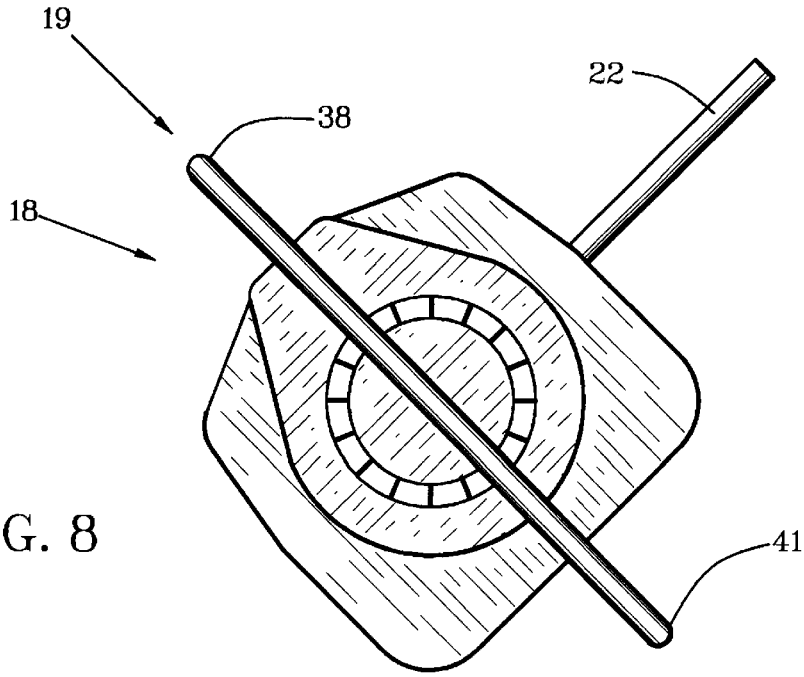
FIG. 8

ENGINE POWERED TORQUE WRENCH

BACKGROUND OF THE INVENTION

1. Field of the Invention

This invention relates to power wrenches and in particular to an engine-powered torque wrench having a loop handle that is orthogonal to a torque handle and in a plane parallel to an axis of a torque-wrench shaft.

2. Relation to Prior Art

Powered torque wrenches generally are tethered to electrical or pneumatic sources of operating power. They do not have non-tethered engine power with a convenient positioning handle in operative relationship to a torque handle in a manner taught by this invention.

One of the large uses of torque wrenches is for tightening and loosening lug nuts on wheels of highway trucks and trailers where electricity or high-pressured air are not available. Previously for this and other torque-wrench applications, hand wrenches have been used. Changing dual wheels on highway trucks with hand-power wrenches is so difficult for truck drivers on roadsides that the dual wheels of flat tires are often not changed. Instead, they are ruined by being driven flat to a repair facility. The cost of a ruined tire or the cost of repair service remote from a repair facility can be about as much as the cost of this engine-powered torque wrench with which numerous wheels can be changed.

There are other uses for this engine-powered torque wrench with comparable economic advantages. It is highly advantageous for use anyplace where electricity or pneumatic power are not readily available for either an electric-powered torque wrench or a pneumatic torque wrench which might be available. Versatility of easy use anywhere renders this invention a torque wrench of choice, even where electricity and/or air power are available.

Examples of most-closely related known but different powered tools are described in the following patent documents:

| Number | Date | Inventor | U.S. Class |
|---|---|---|---|
| U.S. Pat. No. 6,438,852 | 08/02 | Taomo, et al. | 30/383 |
| U.S. Pat. No. 6,182,367 | 02/01 | Janczak | 30/392 |
| U.S. Pat. No. 5,855,067 | 01/99 | Taomo, et al. | 30/122 |

SUMMARY OF THE INVENTION

Objects of patentable novelty and utility taught by this invention are to provide an engine-powered torque wrench which:

- has power remotely from electrical or other fixed-site power sources;
- can be positioned conveniently and accurately from any angle;
- is optionally right-hand or left-hand operable;
- has effective leveraging in opposition to rotational output power; and
- has convenient throttling at a torque handle.

This invention accomplishes these and other objectives with an engine-powered torque wrench having a loop handle that is orthogonal to a torque handle. The engine-powered torque wrench has a heat engine which rotates a tool shaft. The heat engine has a rotary axis that is collinear to a shaft axis of the tool shaft. The loop handle is adapted to be hand-grasped by a first hand of a user for primary support of a system weight of the engine-powered torque wrench while selectively positioning a desired tool on a targeted item. The torque handle is adapted to be hand-grasped by a second hand of the user for secondary support of the system weight while simultaneously using the second hand for assisting in positioning of the tool, leveraging against rotational moment of the tool shaft and throttling the heat engine.

The engine-powered torque wrench is adapted for either right-handed or left-handed use and for either right-side access or left-side access to a wrench-targeted item. For right-handed use and for right-side access to the wrench-targeted item, the torque handle is positioned on a right side of the wrench-targeted item, the loop handle is grasped by the left hand and the torque handle is grasped by the right hand of the user with the user facing the wrench-targeted item. For left-handed use and for left-side access to the wrench-targeted item, the torque handle is positioned on a left side of the wrench-targeted item, the loop handle is grasped by the right hand and the torque handle is grasped by the left hand of the user with the user facing the wrench-targeted item.

The engine-powered torque wrench is adapted for selectively vertical or horizontal orientation of the rotary axis and the shaft axis in accordance with desired objectives in relation to the targeted item. For the selectively vertical or horizontal orientation in relationship to a targeted item that is vertically below the loop handle, the loop handle is adapted to be grasped by a first hand of the user at a position on the loop handle that is vertically higher than the targeted item, while the torque handle is grasped by the second hand of the user and the axis of the tool shaft is collinear to targeted rotation of the tool in relation to the targeted item.

BRIEF DESCRIPTION OF DRAWINGS

This invention is described by appended claims in relation to description of a preferred embodiment with reference to the following drawings which are explained briefly as follows:

FIG. 7 is a left-side view of the FIG. 6 embodiment;

FIG. 8 is an engine-end view of the FIG. 7 illustration in a right-hand slanted orientation for supporting weight with both the loop handle and the torque handle;

DESCRIPTION OF PREFERRED EMBODIMENT

Figure 1:
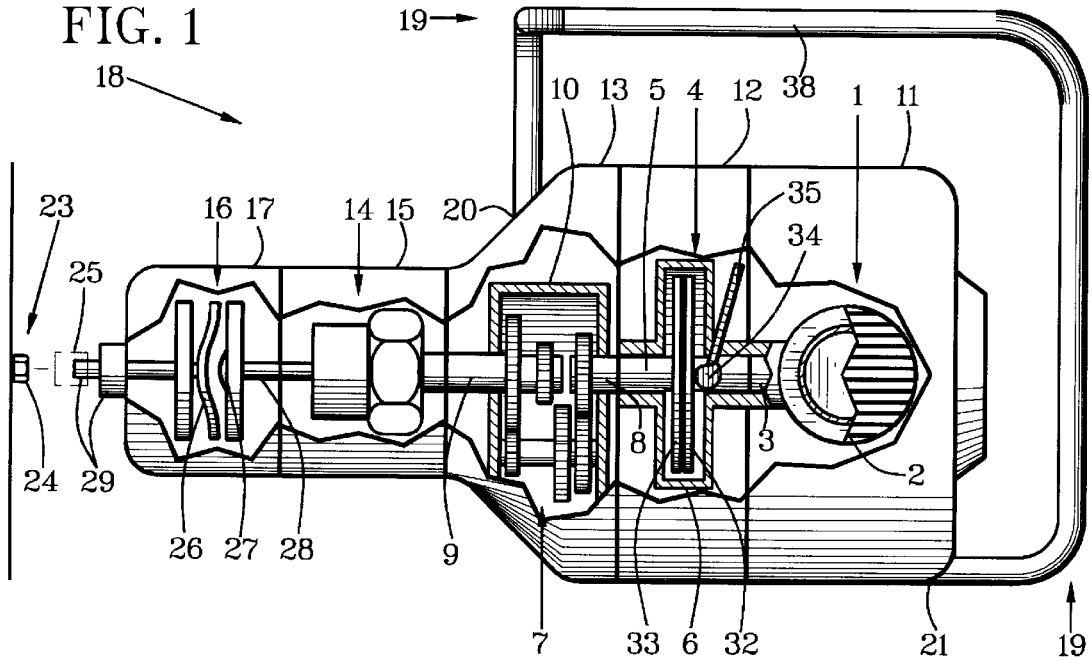
FIG. 1 is a partially cutaway side view of an embodiment of the engine-powered torque wrench having a loop handle extended upwardly from a gear housing, left-sidewardly to a top portion, rearwardly to a rear portion, downwardly to a bottom of an engine housing and inwardly to the engine housing.

Listed numerically below with reference to the drawings are terms used to describe features of this invention. These terms and numbers assigned to them designate the same features throughout this description.

1. Heat engine
2. Engine housing
3. Engine shaft
4. Power-tool clutch
5. Clutch shaft
6. Clutch housing
7. Power-tool gear
8. Gear-input shaft
9. Gear-output shaft
10. Gear housing
11. Engine section
12. Clutch section
13. Gear section
14. Toolhead
15. Toolhead section
16. Striker gear
17. Striker-gear section
18. Engine-powered torque wrench
19. Loop handle
20. First loop end
21. Second loop end
22. Torque rod
23. Targeted item
24. Fastener head
25. Selected tool
26. Wave spring
27. Curve-lobed striker
28. Striker shaft
29. Socket attachment
30. Glow plug
31. Sparkplug
32. Clutch plate
33. Gear plate
34. Eccentric head
35. Control handle
36. External truncate cone
37. Internal truncate cone
38. Top portion
39. Top-front portion
40. Rear portion
41. Bottom portion
42. Bottom-front portion
43. Support member Referring to FIGS. 1–2, an engine-powered torque wrench has a heat engine 1 in an engine housing 2 having an engine-base end and an engine-shaft end. An engine shaft 3 is extended from the engine-shaft end of the engine housing 2.

The heat engine 2 can include any type of prime mover that is powered by fuel heat in contrast to motors which are tethered to electricity, compressed air, water power or other source of energy. Typically, but not necessarily, the heat engine 1 will include a crankshaft-piston engine with a two-stroke cycle because it is the lightest and most convenient prime mover readily available currently.

A power-tool clutch 4 has a clutch shaft 5 with an engine end and a gear end in a clutch housing 6. The engine end of the clutch shaft 5 is coupled to the engine shaft 3 collinearly. The power-tool clutch 4 is a predeterminedly slip clutch having controllable rotational slip per resistance to rotational power of the heat engine 1.

The power-tool clutch 4 can include any of a plurality of classes of clutches that can be adapted to fit and transfer power with controllable slip of rotational power from the heat engine 1.

A power-tool gear 7 with a gear-input shaft 8 and a gear-output shaft 9 is positioned in a gear housing 10 with the gear-input shaft 8 coupled to the gear end of the clutch shaft 5 collinearly.

The engine housing 2 can be adapted to include an engine section 11; the clutch housing 6 can be adapted to include a clutch section 12; the gear housing 10 can be adapted to include a gear section 13; a toolhead 14 can be adapted to include a toolhead section 15; and a striker gear 16 can be adapted to include a striker-gear section 17 of the engine-powered torque wrench 18. The engine-powered torque wrench 18 can be adapted to be predeterminedly concentric or to include separate shapes and forms of the engine housing 2, the clutch housing 6, the gear housing 10, the toolhead section 15 and the striker-gear section 17. Optionally also, the engine-powered torque wrench 18 can be adapted to cover and to house the engine housing 2, the clutch housing 6, the gear housing 10, the toolhead section 15 and the striker-gear section 17 predeterminedly.

The toolhead 14 can include a selection of collets, chucks, fasteners or other holders having a gear end and a tool end with the gear end of the toolhead 14 being coupled to the gear-output shaft 9 collinearly. The toolhead 14 is adapted for detachable attachment of predetermined tools and toolholders selectively.

A loop handle 19 has a first loop end 20 attached to a top side of the engine-powered torque wrench 18 preferably proximate a top side of the gear housing 10 with the power-tool gear 7 having a gear axis oriented horizontally. The loop handle 19 has a second loop end 21 attached to a predetermined portion of a bottom side of the engine-powered torque wrench 18.

A torque handle includes a torque rod 22 with a first end of the torque rod 22 attached to a first side of the engine-powered torque wrench 18 proximate a first side of the engine housing 2. The torque rod 22 is oriented orthogonally to the gear axis.

The loop handle 19 is adapted for first-hand-grasping selectively intermediate the first loop end 20 and the second loop end 21 for supporting weight of the engine-powered torque wrench 18 and for positioning the tool end of the engine-powered torque wrench 18 proximate a targeted item 23 that typically, but not necessarily, will include a fastener head 24 such as a fastener nut or bolt head. A particularly targeted item 23 includes a lug nut on a truck or car wheel.

The torque handle is adapted for second-hand-grasping for aiding in supporting of the weight of the engine-powered torque wrench 18 and in the positioning of a selected tool 25 desirably proximate the targeted item 23. Typically, but necessarily, the selected tool 25 will be a socket wrench.

The torque handle that can include the torque rod 22 can be adapted for operative control of the heat engine 1. The control by the torque handle can include mere positioning aid for heat engines 1 having fixed rotational speed with preset throttling, twisting for motorcycle-like throttling or shifting of a shiftable power-tool gear in combination with throttling of the heat engine 1. The torque handle includes a lever length that is adapted for hand-held resistance to rotational output power that is transmitted to the gear-output shaft 9.

The engine-powered torque wrench 18 can include a light-duty embodiment for which the heat engine 1 preferably but not necessarily has less than one horsepower. For minimizing weight, the heat engine 1 for the light-duty embodiment can be adapted for constant rotational speed with preset throttling and with the power-tool gear 7 being a reduction gear having a single output ratio of speed for transmission to the gear-output shaft 9 in proportion to rotational speed of the heat engine 1.

The toolholder for which the toolhead 14 is adapted for detachable attachment can includes the striker gear 16. The striker gear 16 can be adapted for holding selected tools that are detachably attachable predeterminedly. The striker gear 16 can include a wave-spring striker gear having one or more curve-lobes of a curve-lobed wave spring 26 for being engaged rotationally by one or more curved lobes of a curve-lobed striker 27 that can have a striker shaft 28 adapted for detachable attachment to the toolhead 14. The striker gear 16 can include a socket attachment 29 that is adapted to be inserted into a socket-boss end of a selected conventional wrench socket that is the selected tool 25.

The heat engine 1 can include a glow-plug engine having glow-plug-heat ignition of fuel and compressed air. Optionally also, the heat engine 1 can include a sparkplug engine having sparkplug ignition of the fuel and compressed air. Separate sizes and types of heat engines 1 are not shown because they can be structured the same. Shown in FIG. 2, however is a representation of a glow plug 30 that is longer than a representation of a sparkplug 31 in FIG. 3.

The slip clutch of the power-tool clutch 4 can include a clutch plate 32 which is attached to the clutch shaft 5 for being rotated by the heat engine 1. The slip clutch also can include a gear plate 33 that is attached to the gear end of the clutch shaft 5 for rotation of the gear-input shaft 8.

A slip-control member can be positioned proximate a gear side of the clutch plate 32 for controlling contact and tightness of contact of the clutch plate 32 with the gear plate 33. Shown in FIG. 1 is an eccentric head 34 on a control handle 35 for representing an optional means for pressuring of the clutch plate 32 against the gear plate 33 of the power-tool clutch 4 selectively. Other means are known and still other means are foreseeable for controlling slip in order to control output torque that is transmitted to the selected tool 25.

Figure 3:
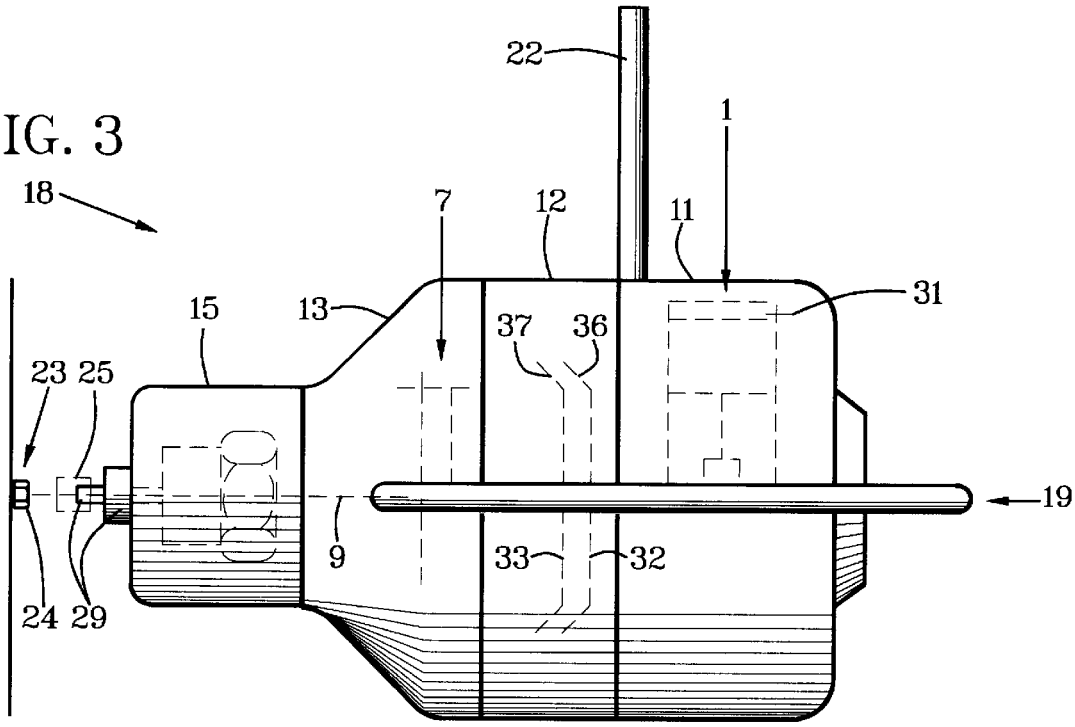
FIG. 3 is a side view of an embodiment showing internal features with dashed lines and having a loop handle that is centered for balanced weight distribution.
Figure 4:
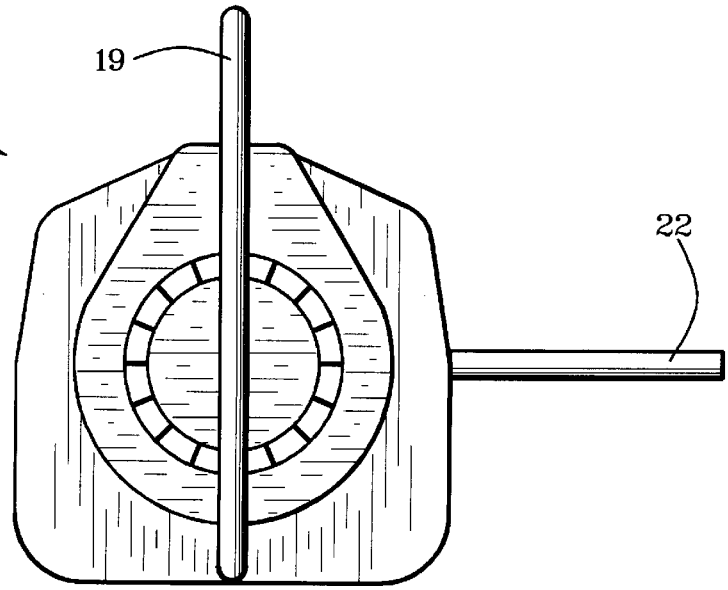
FIG. 4 is an engine-end view of the FIG. 3 embodiment.

As shown in FIG. 3, the clutch plate 32 can include an external truncate cone 36 and the gear plate 33 can include an internal truncate cone 37 that is adapted to be received by the external truncate cone 36 of the clutch plate 32 predeterminedly.

Optionally as shown in FIG. 7, the gear plate 33 can include the external truncate cone 36 and the clutch plate 32 can include the internal truncate cone 37 that is adapted to be received by the external truncate cone 36 of the gear plate 33 predeterminedly.

For a heavy-duty embodiment, the heat engine 1 has more than one horsepower. For both the heavy-duty embodiment and the light-duty embodiment, the heat engine 1 can be adapted for variable rotational speed with throttle control preferably at the toque rod 22 and optionally also by variable output ratio of speed of the power-tool gear 7 in proportion to rotational speed of the heat engine 1. The power-tool gear 7 can include a reduction gear having a plurality of output ratios of speed for transmission to the gear-output shaft 9 in proportion to rotational speed of the heat engine 1. For both the heavy-duty embodiment and the light-duty embodiment, the heat engine 1 can be adapted also for the power-tool gear 7 to include a reduction gear having a single output ratio of speed for transmission to the gear-output shaft 9 in proportion to rotational speed of the heat engine 1.

The loop handle 19 can include a top portion 38 that is positioned predeterminedly proximate a center of gravity vertically above the engine housing 2 with the axis of the gear-output shaft 9 being oriented horizontally for support of approximately a total weight of the engine-powered torque wrench 18 with the torque handle and the torque rod 22 thereof being oriented approximately horizontal as shown in FIGS. 1–4, 7, and 9.

The loop handle 19 and the torque rod 22 of the torque handle are adapted for selectable balance of support of the weight of the engine-powered torque wrench 18 with an axis of the gear-output shaft 9 being about horizontal and the torque handle being rotated selectively intermediate horizontality and approximately forty-five degrees from horizontality as shown in FIG. 8.

Figure 2:
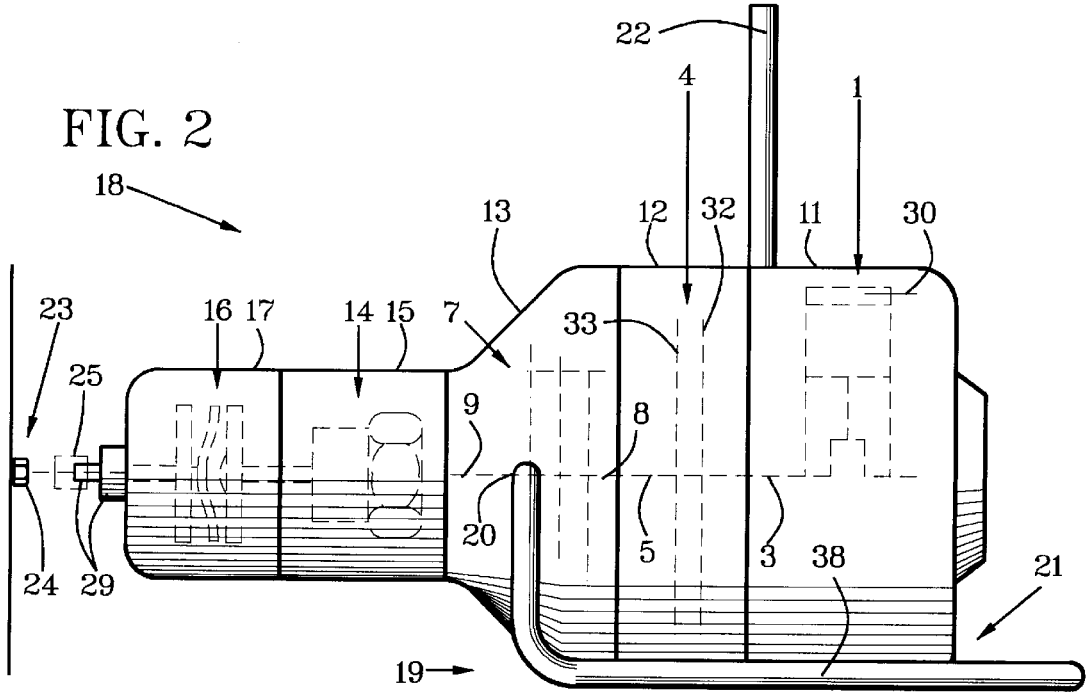
FIG. 2 is a top view of the FIG. 1 embodiment showing a torque handle extended orthogonally to the loop handle and to an axis of the engine-powered torque wrench.
Figure 5:
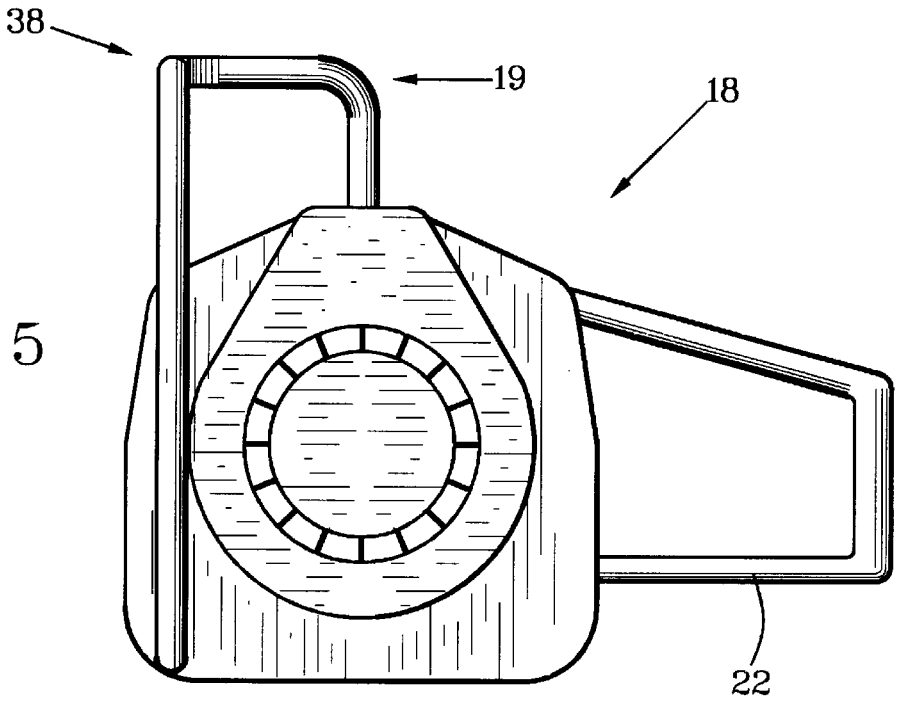
FIG. 5 is an engine-end view of the FIG. 1 embodiment and having a torque handle with dual rods.
Figure 6:
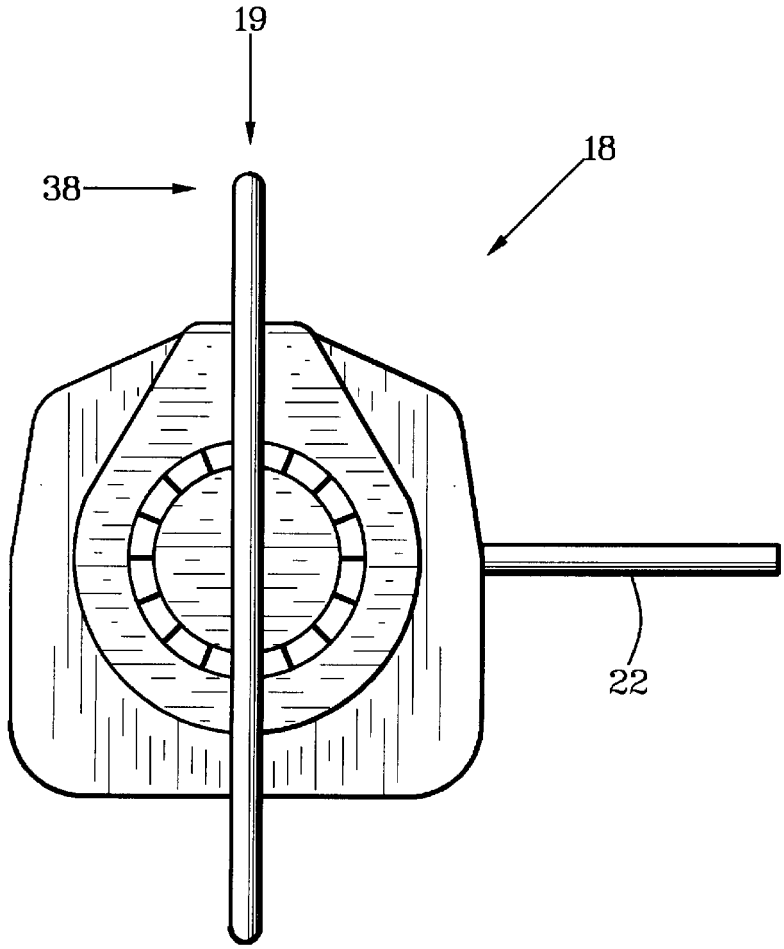
FIG. 6 is an engine-end view of an embodiment having a loop handle that is centered and extended both upwardly and downwardly from the engine-powered torque wrench.

The loop handle 19 can include the top portion 38 of the loop handle being positioned predeterminedly off of the center of gravity vertically above the engine housing 2 with an axis of the engine-powered torque wrench 18 being about horizontal for support of predetermined portions of the total weight of the engine-powered torque wrench 18 with the loop handle 19 and the torque handle having the torque rod 22 as shown in FIGS. 1–2 and 5.

Figure 9:
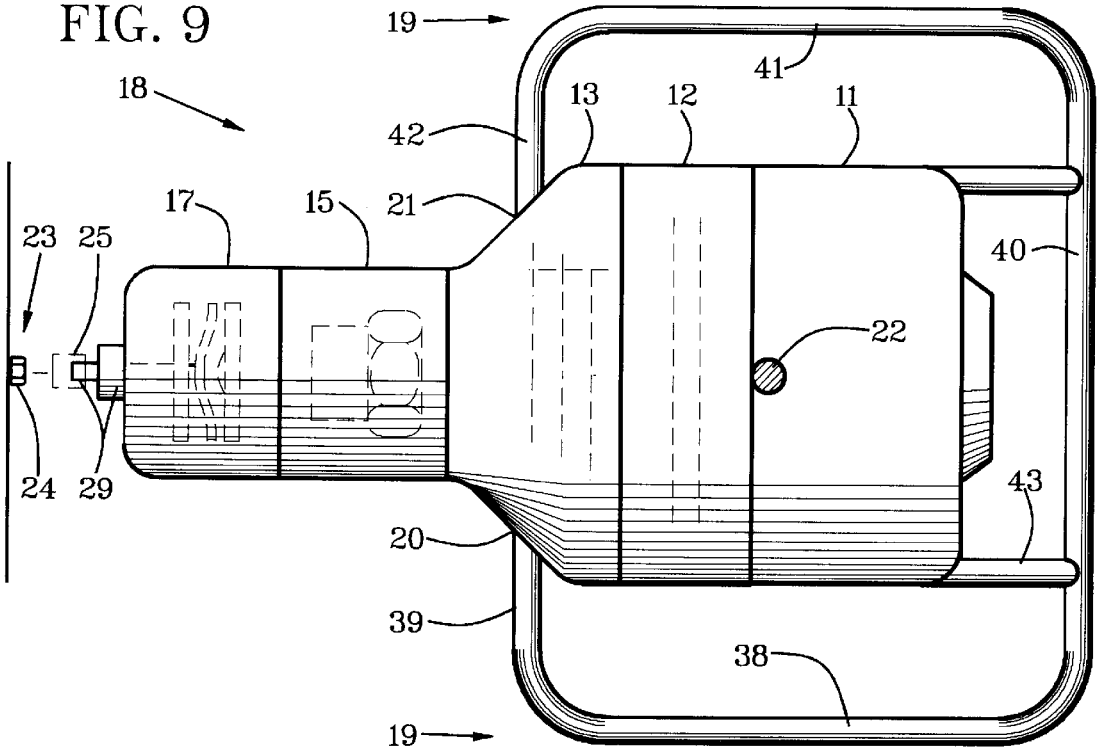
FIG. 9 is a right-side view of the FIG. 7 embodiment showing the torque handle extended from a right side for left-handed use or for left-side use.
Figure 10:
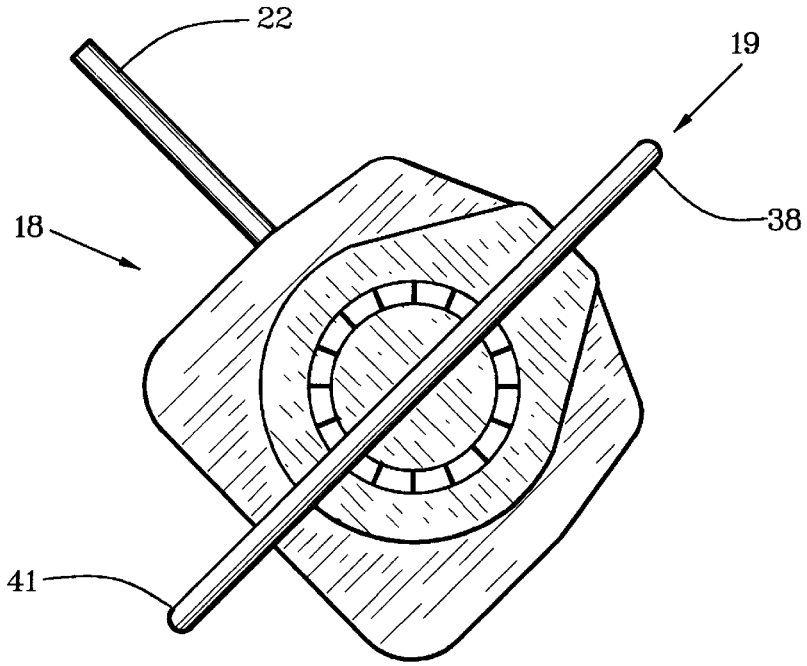
FIG. 10 is an engine-end view of the FIG. 9 illustration in a left-hand slanted orientation for supporting weight with both the loop handle and the torque handle.
Figure 11:
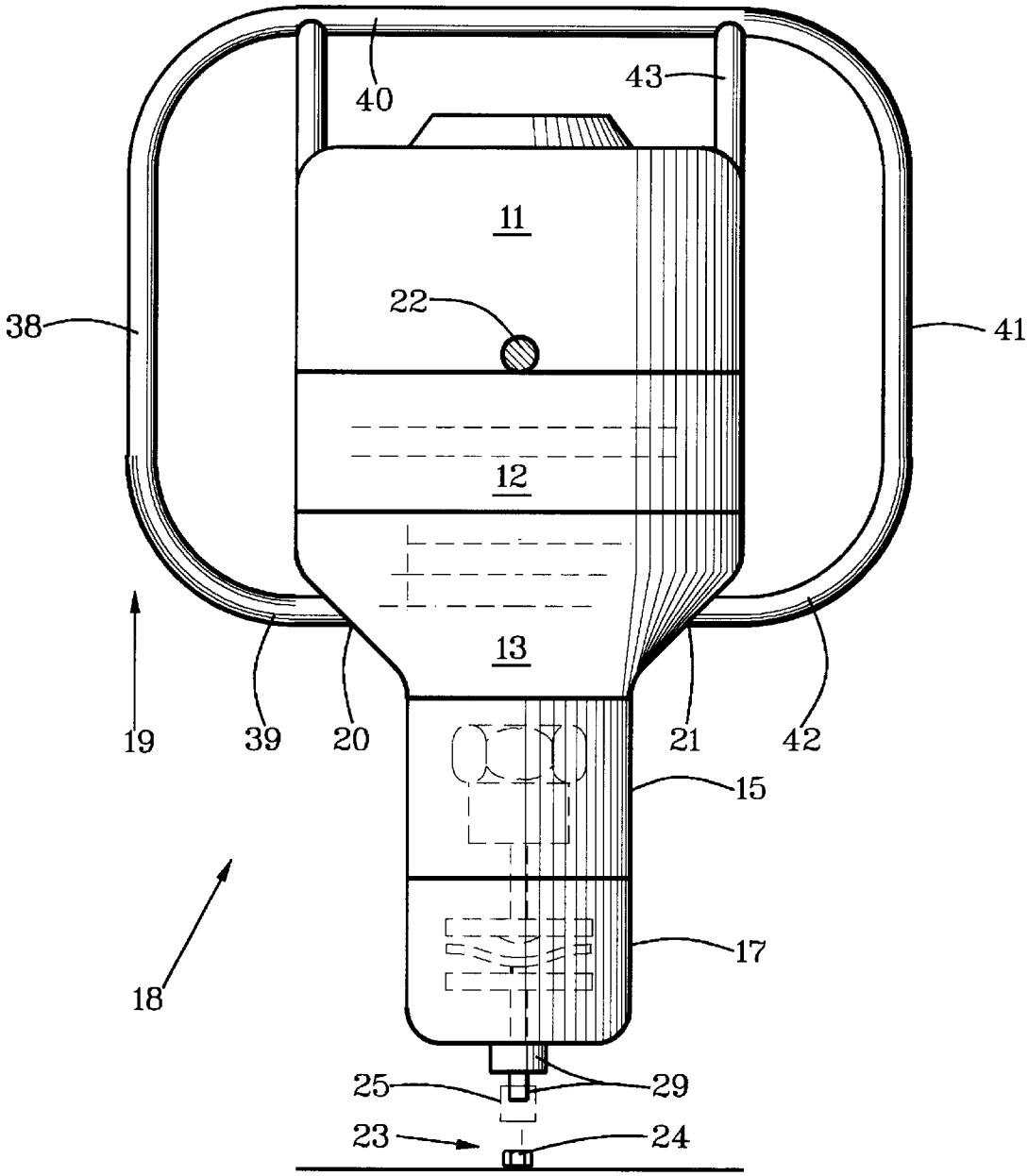
FIG. 11 is a side view of an embodiment with the loop handle centered and with the engine-powered torque wrench oriented vertically for accessing targeted items from an upward orientation.

Referring to FIGS. 7, 9 and 11, the loop handle 19 can include a wrench-balance circuit in relationship to the axis of the engine-powered torque wrench 18 being oriented horizontally. The wrench-balance circuit includes a top-front portion 39, the top portion 38, a rear portion 40, a bottom portion 41 and a bottom-front portion 42 of the loop handle 19. The top-front portion 39 is extended upward vertically from proximate a top portion of the gear section 13 to the top portion 38 of the loop handle 19. The top portion 38 of the loop handle 19 is extended rearwardly to the rear portion 40 of the loop handle 19 which is aft of the engine housing 2 predeterminedly and extended downwardly to the bottom portion 41 of the loop handle 19 which is predeterminedly below the engine housing 2. The bottom portion 41 of the loop handle 19 is extended forwardly to the bottom-front portion 42 of the loop handle 19. The bottom-front portion 42 of the loop handle 19 is extended upward vertically and attached to the engine-powered torque wrench 18 proximate a bottom portion of the gear housing 10.

The loop handle 19 can include a loop plane that is approximately parallel to the axis of the engine-powered torque wrench 18 which can be adapted to have about equal weight on opposite sides of the loop plane with the loop handle 19 being positioned proximate a center of gravity of the engine-powered torque wrench 18 linearly intermediate the tool end of the engine-powered torque wrench 18 and a starter for the heat engine 1 that is oppositely disposed from the tool end.

The engine-powered torque wrench 18 can be adapted to have predeterminedly near equal weight in all directions radially from the axis of the engine-powered torque wrench 18.

At least one support member 43 can be positioned intermediate the engine section 11 and the loop handle 19.

The wrench-balance circuit of the loop handle 19 allows use of the engine-powered torque wrench 18 from either side by either left-or-right-handed users or vertically by either left-or-right-handed users. For left-handed users and for left-side access, the engine-powered torque wrench 18 is oriented upside down with the top portion 38 being on a bottom side and with the torque rod 22 being on the left side as shown in FIG. 9.

A new and useful engine-powered torque wrench having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. An engine-powered torque wrench comprising:

a heat engine in an engine housing having an engine-base end and an engine-shaft end;

an engine shaft extended from the engine-shaft end of the engine housing;

a power-tool clutch with a clutch shaft having an engine end and a gear end in a clutch housing;

the engine end of the clutch shaft being coupled to the engine shaft collinearly;

the power-tool clutch being a predeterminedly slip clutch having controllable rotational slip per resistance to rotational power of the heat engine;

a power-tool gear with a gear-input shaft and a gear-output shaft in a gear housing;

the gear-input shaft being coupled to the gear end of the clutch shaft collinearly;

a toolhead with a gear end and a tool end;

the gear end of the toolhead being coupled to the gear-output shaft collinearly;

the toolhead being adapted for detachable attachment of predeterminedly selected tools and toolholders selectively;

a loop handle having a first loop end attached to a top side of the engine-powered torque wrench with the power-tool gear having a gear axis oriented horizontally;

the loop handle having a second loop end attached to a predetermined portion of a bottom side of the engine-powered torque wrench;

a torque handle having a torque rod with a first end of the torque rod attached to a first side of the engine-powered torque wrench proximate a first side of the engine housing;

the torque rod being oriented orthogonally to the gear axis;

the loop handle being adapted for first-hand-grasping selectively intermediate the first loop end and the second loop end for supporting weight of the engine-powered torque wrench and for positioning the tool end of the toolhead proximate a targeted item;

the torque handle being adapted for second-hand-grasping for aiding in the supporting of the weight of the engine-powered torque wrench and in the positioning of the selected tool desirably proximate the targeted item; and the torque handle being adapted for operative control of the heat engine.

2. The engine-powered torque wrench of claim 1 wherein:

the torque handle includes a lever length that is adapted for hand-held resistance to rotational output power that is transmitted to the gear-output shaft.

3. The engine-powered torque wrench of claim 1 wherein:

the engine-powered torque wrench includes a light-duty embodiment for which the heat engine has less than one horsepower;

the heat engine is adapted for constant rotational speed; and the power-tool gear includes a reduction gear having a single output ratio of speed for transmission to the gear-output shaft in proportion to rotational speed of the heat engine predeterminedly.

4. The engine-powered torque wrench of claim 3 wherein:

the toolholder for which the toolhead is adapted for detachable attachment includes a striker gear; and the striker gear is adapted for holding selected tools that are detachably attachable predeterminedly.

5. The engine-powered torque wrench of claim 4 wherein:

the striker gear includes a wave-spring striker gear having one or more curved lobes of a curve-lobed wave spring for being engaged rotationally by one or more curved lobes of a curve-lobed striker; and the curve-lobed striker has a striker shaft adapted for detachable attachment to the toolhead.

6. The engine-powered torque wrench of claim 5 wherein:

the striker gear includes a socket attachment that is adapted to be inserted into a socket-boss end of a selected conventional wrench socket.

7. The engine-powered torque wrench of claim 1 wherein:

the heat engine includes a glow-plug engine having glow-plug-heat ignition of fuel and compressed air.

8. The engine-powered torque wrench of claim 1 wherein:

the heat engine includes a sparkplug engine having spark-plug ignition of the fuel and compressed air.

9. The engine-powered torque wrench of claim 1 wherein:

the slip clutch includes a clutch plate which is attached to the clutch shaft for being rotated by the heat engine;

the slip clutch plate includes a gear plate that is attached to the gear end of the clutch shaft for rotation of the gear-input shaft; and a slip-control member is positioned proximate a gear side of the clutch plate for controlling contact and tightness of contact of the clutch plate with the gear plate.

10. The engine-powered torque wrench of claim 9 wherein:

the clutch plate includes an external truncate cone; and the gear plate includes an internal truncate cone that is adapted to be received by the external truncate cone of the clutch plate predeterminedly.

11. The engine-powered torque wrench of claim 9 wherein:

the gear plate includes the external truncate cone; and the clutch plate includes the internal truncate cone that is adapted to be received by the external truncate cone of the gear plate predeterminedly.

12. The engine-powered torque wrench of claim 1 wherein:

the engine-powered torque wrench includes a heavy-duty embodiment for which the heat engine has more than one horsepower.

13. The engine-powered torque wrench of claim 12 wherein:

the power-tool gear includes a reduction gear having a plurality of output ratios of speed for transmission to the gear-output shaft in proportion to rotational speed of the heat engine.

14. The engine-powered torque wrench of claim 12 wherein:

the power-tool gear includes a reduction gear having a single output ratio of speed for transmission to the gear-output shaft in proportion to rotational speed of the heat engine.

15. The engine-powered torque wrench of claim 12 wherein:

the toolholder for which the toolhead is adapted for detachable attachment includes a striker gear; and the striker gear includes a striker-gear tool holder that is adapted for holding selected tools that are detachably attachable predeterminedly.

16. The engine-powered torque wrench of claim 15 wherein:

the striker-gear holder includes a socket-attachment boss that is adapted to be inserted into a socket-boss end of a selected conventional wrench socket.

17. The engine-powered torque wrench of claim 1 wherein:

the loop handle includes a top portion of the loop handle being positioned predeterminedly proximate a center of gravity vertically above the engine housing with the axis of the gear-output shaft being oriented horizontally for support of approximately a total weight of the engine-powered torque wrench with the torque handle being oriented approximately horizontal.

18. The engine-powered torque wrench of claim 1 wherein:

the loop handle and the torque handle are adapted for selectable balance of support of the weight of the engine-powered torque wrench with an axis of the tool shaft being about horizontal and the torque handle being rotated selectively intermediate horizontality and approximately forty-five degrees from horizontality.

19. The engine-powered torque wrench of claim 1 wherein:

the loop handle includes the top portion of the loop handle being positioned predeterminedly off of the center of gravity vertically above the engine housing with an axis of the engine-powered torque wrench being about horizontal for support of predetermined portions of the total weight of the engine-powered torque wrench with the loop handle and the torque handle.

20. The engine-powered torque wrench of claim 1 wherein:

the loop handle includes a wrench-balance circuit in relationship to the axis of the engine-powered torque wrench being oriented horizontally;

the wrench-balance circuit includes a top-front portion, a top portion, a rear portion, a bottom portion and a bottom-front portion of the loop handle;

the top-front portion is extended upward vertically from proximate a top portion of the gear section to the top portion of the loop handle;

the top portion of the loop handle is extended rearwardly to the rear portion of the loop handle which is aft of the engine housing predeterminedly and extended downwardly to the bottom portion of the loop handle which is predeterminedly below the engine housing;

the bottom portion of the loop handle is extended forwardly to the bottom-front portion of the loop handle; and the bottom-front portion of the loop handle is extended upward vertically and attached to the engine-powered torque wrench proximate a bottom portion of the gear housing.

21. The engine-powered torque wrench of claim 20 wherein:

the loop handle includes a loop plane that is approximately parallel to the axis of the engine-powered torque wrench;

the engine-powered torque wrench is adapted to have about equal weight on opposite sides of the loop plane; and the torque handle is positioned proximate a center of gravity of the engine-powered torque wrench linearly intermediate the tool end of the toolhead and a starter for the heat engine that is oppositely disposed from the tool end of the engine-powered torque wrench.

22. The engine-powered torque wrench of claim 21 wherein:

the engine-powered torque wrench is adapted to have predeterminedly near equal weight in all directions radially from the axis of the engine-powered torque wrench.

23. The engine-powered torque wrench of claim 22 and further comprising:

at least one support member intermediate the engine section and the loop handle.

* * * * *